US012018924B2

(12) United States Patent
Gestoso

(10) Patent No.: US 12,018,924 B2
(45) Date of Patent: Jun. 25, 2024

(54) PROJECTILE DEVICE

(71) Applicant: Mario Gestoso, Huntington Beach, CA (US)

(72) Inventor: Mario Gestoso, Huntington Beach, CA (US)

( * ) Notice: Subject to any disclaimer, the term of this patent is extended or adjusted under 35 U.S.C. 154(b) by 0 days.

(21) Appl. No.: 17/869,527

(22) Filed: Jul. 20, 2022

(65) Prior Publication Data

US 2023/0024867 A1 Jan. 26, 2023

Related U.S. Application Data

(60) Provisional application No. 63/223,662, filed on Jul. 20, 2021.

(51) Int. Cl.

| | |
|---|---|
| ***F42B 6/04*** | (2006.01) |
| ***A63B 65/02*** | (2006.01) |
| ***F42B 6/00*** | (2006.01) |
| ***F42B 6/08*** | (2006.01) |

(52) U.S. Cl.

CPC ..... *F42B 6/08* (2013.01); *F42B 6/003* (2013.01); *F42B 6/04* (2013.01)

(58) Field of Classification Search

CPC .... F41B 3/02; F42B 6/003; F42B 6/04; F42B 6/06; F42B 6/08

See application file for complete search history.

(56) References Cited

U.S. PATENT DOCUMENTS

| | | | | | |
|---|---|---|---|---|---|
| 65,376 | A * | 6/1867 | Griffin | F41B 3/02 | 124/20.3 |
| 236,691 | A * | 1/1881 | Parsil | F41B 3/04 | 124/17 |
| 2,282,764 | A * | 5/1942 | Lazzari | F41B 3/02 | 124/26 |
| 2,691,973 | A * | 10/1954 | Hutson | F42B 6/04 | 473/585 |
| 2,828,965 | A * | 4/1958 | Schwitzki | F42B 6/04 | 473/586 |
| 4,002,236 | A * | 1/1977 | Tolleson | F41B 5/12 | 124/31 |
| 5,902,199 | A * | 5/1999 | Adams, Jr. | F42B 6/04 | 473/578 |
| 6,758,772 | B1 * | 7/2004 | Chambers | F42B 6/003 | 473/578 |
| 8,162,784 | B1 * | 4/2012 | Bellefeuille | F42B 6/08 | 124/20.3 |
| 8,991,373 | B2 * | 3/2015 | Cummings | F41B 7/08 | 124/20.3 |
| 9,903,681 | B2 * | 2/2018 | Walterscheid | A63H 27/14 | |
| 9,982,973 | B2 * | 5/2018 | Emert | F42B 6/003 | |

(Continued)

*Primary Examiner* — John A Ricci
(74) *Attorney, Agent, or Firm* — Brennan, Manna & Diamond, LLC

(57) ABSTRACT

The present invention relates generally to a new and improved projectile. More specifically, the invention relates to a compact and durable projectile that has a singular shaft-like body that is manufactured from stainless steel or other suitable materials. The projectile has a pointed tip, a handle, and a notch that allows the projectile to be pulled back against an elastic or tensioned member to ultimately propel the projectile towards its intended target upon its release. Differing embodiments of the projectile may also have various removable aerodynamic fins and arrow-head-like tips.

9 Claims, 5 Drawing Sheets

(56) References Cited

U.S. PATENT DOCUMENTS

| | | | | |
|---|---|---|---|---|
| 10,066,912 | B2 * | 9/2018 | Grace | A63B 69/00 |
| 10,281,251 | B2 * | 5/2019 | Jackson | F41J 3/0057 |
| 2008/0090684 | A1 * | 4/2008 | Martinez | F42B 6/003 473/578 |
| 2010/0207330 | A1 * | 8/2010 | Yaroch | F41J 3/00 273/358 |
| 2019/0204052 | A1 * | 7/2019 | Foster | F42B 6/08 |
| 2021/0302140 | A1 * | 9/2021 | Terry | F42B 10/12 |

* cited by examiner

PROJECTILE DEVICE

CROSS-REFERENCE TO RELATED APPLICATION

The present application claims priority to and the benefit of U.S. Provisional Application No. 63/223,662 filed on Jul. 20, 2021, which is incorporated herein by reference in its entirety.

FIELD OF THE INVENTION

The present invention relates generally to a new and improved projectile device. More specifically, the invention relates to a compact and durable projectile that is comprised of a singular shaft-like body, and that is preferably constructed from a stainless steel or another hardened alloy. The improved projectile is further comprised of a pointed tip, a handle, and a notch that allows the projectile to be pulled back against an elastic member, string or strand that is under tension to ultimately propel the projectile upon its release by the user. Differing embodiments of the projectile may also include various removable aerodynamic fins and/or head-like tips. Accordingly, the present specification makes specific reference thereto. However, it is to be appreciated that aspects of the present invention are also equally amenable to other like applications, devices, and methods of manufacture.

BACKGROUND OF THE INVENTION

By way of background, many hunters, archers, and hobbyists alike utilize arrows and other projectiles for a variety of purposes including, without limitation, hunting, spear fishing, competition target shooting, entertainment, and general hobby target shooting. However, in each of these respective activities, the use of arrows suffer from a number of fundamental inefficiencies and drawbacks that are in need of a remedy.

For example, individuals who utilize arrows for hunting purposes may encounter a fundamental flaw in the common arrow, that being its lack of durability. More specifically, it is not uncommon for a hunter to shoot an arrow at a game animal, and have a portion of the arrow break—either the shaft or the arrowhead—after entering (or exiting) the target animal. This breakage can occur simply because of a lack of durability of the shaft/arrowhead material, or via the thrashing/fleeing of the animal after it has been hit by the arrow or where the arrow has completely passed through the target animal and has become lodged in the ground, a tree, etc. Further, commercial hunting arrows and arrowheads can be expensive to replace depending on the manufacturer/model, and especially so if breakage occurs repeatedly. Additionally, breakage of the arrow/arrowhead within the game animal may lead to prolonged suffering/pain for the animal, which presents certain ethical challenges and is an undesirable outcome for hunters.

Competition archers and general hobbyist archers are also plagued with another deficiency in the common arrow in the form of the overall form-factor of existing arrows. For example, existing arrows are generally quite large and cumbersome to use. As such, the size of an arrow may prove difficult, and certainly not optimal, when attempting to transport a large number of arrows, especially as no compact carrying alternative or solution exists. Further, archers and hunters alike would readily accept a projectile that is more aerodynamic, and that could travel further and at a greater speed than the conventional arrow. In addition, no such projectile exists in the art that allows an individual to utilize a device that is more portable and discrete than a bow/crossbow (e.g. a slingshot or similar-type elastic device) in conjunction with an arrow-like projectile that can be used for hunting or general/competition target shooting purposes.

Therefore, there exists a long felt need in the art for an improved projectile for use in hunting, spear fishing, competition target shooting, entertainment, and general hobby target shooting. There is also a long felt need in the art for an improved arrow projectile that exhibits greater durability, is more compact in size, and provides improved aerodynamic properties over existing arrows or arrow-type devices known in the art. Moreover, there is a long felt need in the art for an improved projectile that possesses arrow-like qualities, such that the projectile can be used with smaller and more compact projectile-launching devices, such as a slingshot or other elastic or tension based propelling means. Finally, there exists a long felt need in the art for an improved projectile device that is relatively inexpensive to manufacture, and that is both safe and easy to use.

The present invention, in one exemplary embodiment, discloses an improved arrow-like projectile that is preferably constructed from stainless-steel to form the shaft or body. The body has a first end that includes a pointed tip, and a second end that has a handle or grooved surface that allows a user to grip the projectile. The body of the improved projectile is further comprised of a generally triangular shaped notch that allows the projectile to engage an elastic or tensioned member of a bow, slingshot, elastic band, etc., such that when a user pulls the projectile back against the tensioned member and then releases the projectile, the projectile is propelled in the direction in which it was aimed. Differing embodiments of the improved projectile may further comprise additional aerodynamic body members such as, but not limited to, fins.

In this manner, the improved projectile device of the present invention accomplishes all of the forgoing objectives, and provides a user with a more compact, durable, and aerodynamic projectile. The improved projectile device also allows a user to make use of a projectile with arrow-like qualities with a plurality of different propelling devices including, without limitation, a bow, a cross bow, a slingshot, or any other tensioned device capable of launching a projectile.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises an improved projectile. The projectile is a one-piece shaft-like body that is preferably constructed of stainless steel, or another durable metal material. The body further comprises a first end having a pointed tip for penetrating a target, and an opposing second end that has a means to allow a user to grasp the body with their fingers. The second end and its grasping area may further include a handle in the form or a grooved and/or textured surface to aid the user in securely handling the improved projectile during use.

The body of the improved projectile further comprises a generally triangular shaped notch that has two walls that form an acute or right angle. One wall of the notch allows the user to pull the device backwards against an elastic or tensioned member (e.g. the string of a bow, the elastic band of a slingshot, etc.) to ultimately propel the projectile. More specifically, the fire the projectile, the user would grasp the projectile's second end, pulling it backwards against the elastic or tensioned member, aim at the intended target and release the user's grip on the projectile, at which time the releasing of the tension built up in the string will propel the projectile in the direction of its intended target.

Additional embodiments of the improved projectile may include a series of removable arrow-head-like tips positioned on the first end of the body, and/or a plurality of interchangeable aerodynamic fins that may be removably or fixedly attached to the second end of the body. In addition, the device may also include an elastic band or tension means to propel the device without the need of a larger device (e.g. slingshot or bow) and also a target shooting game to allow the user to practice their accuracy with the device when not engaged in competition, hunting, spear fishing or the like.

In a further exemplary embodiment of the present invention, a projectile kit is disclosed. The projectile kit is a package having a plurality of targets disposed within the kit, at least one projectile, a plurality of fins attachable to the second end of the at least one projectile, and a plurality of tips attachable to the first end of the at least one projectile. The plurality of targets included within the kit can be used to hone the user's skills in firing the projectile, and the included projectile can also be used in a plurality of other activities including, without limitation, hunting, spear fishing, competition target shooting, entertainment, and general hobby target shooting.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
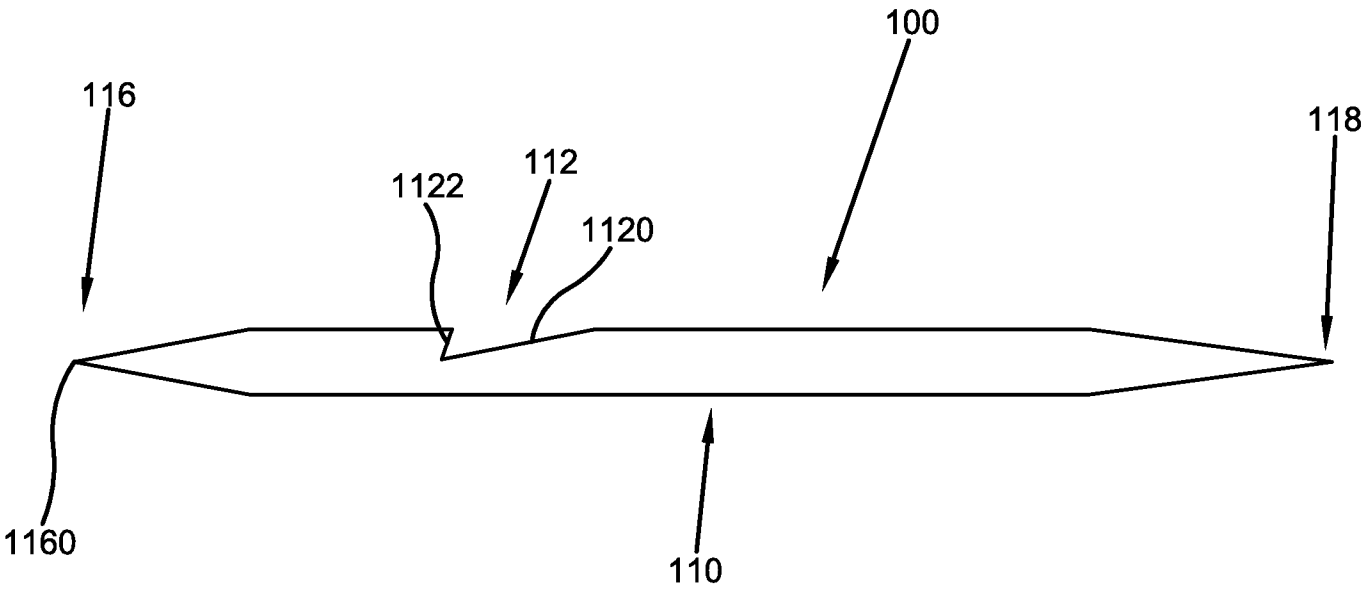
FIG. 1 illustrates a side perspective view of one potential embodiment of an improved projectile device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

As noted above, there is a long felt need in the art for an improved projectile device that overcomes the above stated limitations of current projectile devices. More specifically, there is a long felt need in the art for an improved projectile that provides better durability, takes up less space than conventional projectiles, and gives the user improved aerodynamic properties over existing arrows or arrow-type devices known in the art. Moreover, there is a long felt need in the art for an improved projectile that possess arrow-like qualities, such that the projectile can be used with smaller and more compact projectile-launching devices, such as a slingshot or other elastic or tension based propelling means. Finally, there exists a long felt need in the art for an improved projectile device that is relatively inexpensive to manufacture, and that is both safe and easy to use.

Referring initially to the drawings, FIG. 1 illustrates a side perspective view of one potential embodiment of an improved projectile device 100 of the present invention in accordance with the disclosed architecture. More specifically, the improved projectile device 100 is preferably comprised of a generally tubular, shaft-like body 110 that has a first end 116 and a second end 118. The body 110 is preferably manufactured from a singular piece of stainless steel, or other durable alloy. Further, the stainless steel used for the body portion 110 may be comprised of a chromium, nickel, manganese alloy, chromium nickel alloy, ferritic alloy or martensitic alloy. In one preferred embodiment, the projectile device 100 is comprised of a chromium nickel alloy. Notwithstanding, the improved projectile device 100 is not so limited, and it is contemplated that the same could also be manufactured from a plurality of other durable and relatively lightweight materials including, but not limited to, aluminum, carbon fiber, wood, rubber, rigid plastic, etc. Additionally, the body portion 110 may be comprised of two, generally cylindrical members (not shown) that are fixedly attached together during the manufacturing process.

As best shown in FIG. 1, the first end 116 of the body portion 110 preferably has a singular pointed tip 1160 that allows the projectile device 100 to penetrate its intended target, such as an animal or other target surface. Nonetheless, body portion 110 is not so limited, and it is also contemplated that the first end 116 may have a plurality of differing tip configurations which may include, but are not limited to, a multi-pronged/multi-point head, a serrated tip, a barbed tip, a hooked tip, a blunt-tip, a bullet-shaped tip, a broadhead-shaped tip, a grabbing tip, a field-like tip, etc. Similarly, the first end 116 of body portion 110 may have a removable tip 1160 that can be replaced with a plurality of differing or similar tip types. For example, a pointed tip may be useful for target shooting or hunting wherein the tip will penetrate its intended target, whereas a blunt tip may be attached to the first end 116 of the body portion 110 for training purposes, such as when a user does not desire for the projectile 100 to penetrate the intended target. In any event, the various removable tips may be attached to the first end 116 of the body portion 110 by any commonly known attachment means, such as threading, a male/female connection, etc.

Figure 4:
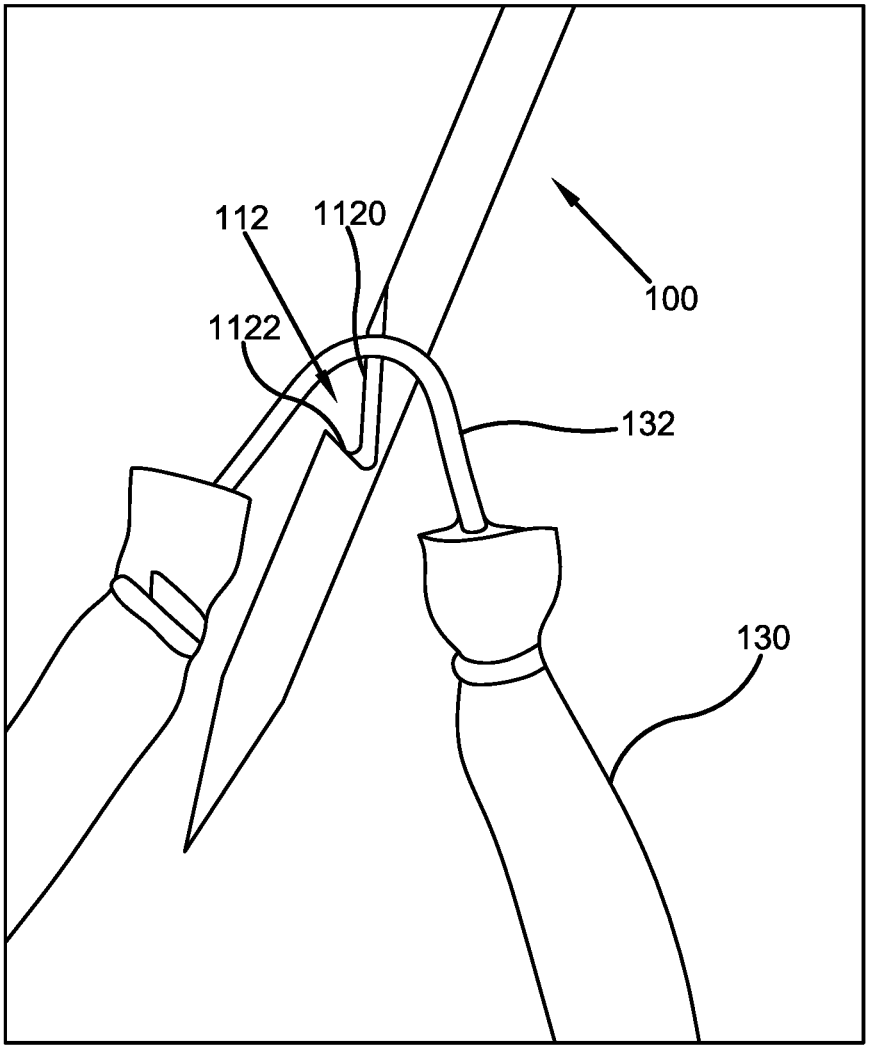
FIG. 4 illustrates a perspective view of one potential embodiment of an improved projectile device of the present invention in accordance with the disclosed architecture, and being used with a tensioned device for firing the improved projectile device.

As also best shown in FIG. 1, the body portion 110 is further comprised of a generally triangular shaped notch 112 in its exterior surface that is positioned between the first end 116 and the second end 118 of the body portion 110. As explained more fully below in relation to FIG. 4, the notch 112 interacts with a notch engaging member 132 to fire, propel or otherwise set the projectile 100 in motion. The notch 112 is comprised of a first wall 1120 and a second wall 1122, which are preferably manufactured in such a manner as to form an acute angle (or, alternatively, in a differing embodiment, a right angle) between the first and second walls 1120, 1122 respectively. The first wall 1120 further allows the notch engaging member 132 (as best shown in FIG. 4) to engage the second wall 1122 of the projectile device 100 near the centerline of the body portion 110, whereby the device 100 can be pulled backwards against a notch-engaging member 132 in a manner that will be described more fully below.

Figure 2:
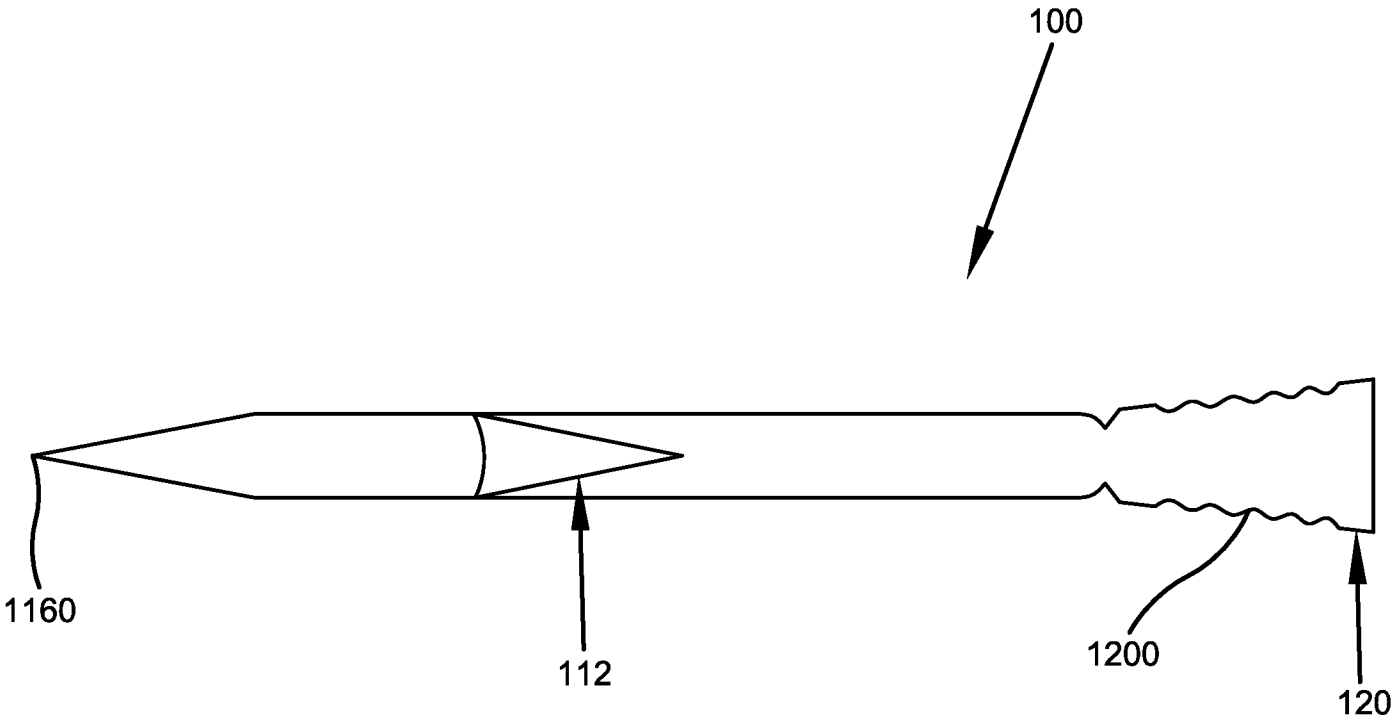
FIG. 2 illustrates a top perspective view of one potential embodiment of an improved projectile device of the present invention in accordance with the disclosed architecture.

FIG. 2 illustrates a top perspective view of one potential embodiment of the improved projectile device 100 of the present invention in accordance with the disclosed architecture. In this particular embodiment, the second end 118 of the body portion is further comprised of a handle 120 that allows the user to better grasp the projectile device 100 with their fingers to, for example, assuredly pull the projectile device 100 backwards against the elastic band 130 (as described more fully below) to create the tension therein that, when released, will propel the projectile device 100 in the direction of its intended target.

In one embodiment, the handle 120 may be wider (e.g., flared) than the body portion 110 to allow a user to obtain a better grip on the body portion 110 as a whole. Further, the handle 120 may have a plurality of different means to enhance a user's grip on the surface of the handle 120 which may include, but is not limited to, molded finger-grooves, stippling, knurling, scaling, jagged protrusions, ridges and valleys 1200, etc. Further, the body portion 110 of the projectile device 100 may also taper towards a base 1202 of the handle 120 before flaring out into the broader handle portion 1204, as best shown in FIG. 2. In a further embodiment, the handle 120 may also comprise a means to receive an archery bow style trigger release, which may further allow a user to pull back on the projectile device 100 to launch the same.

Figure 3:
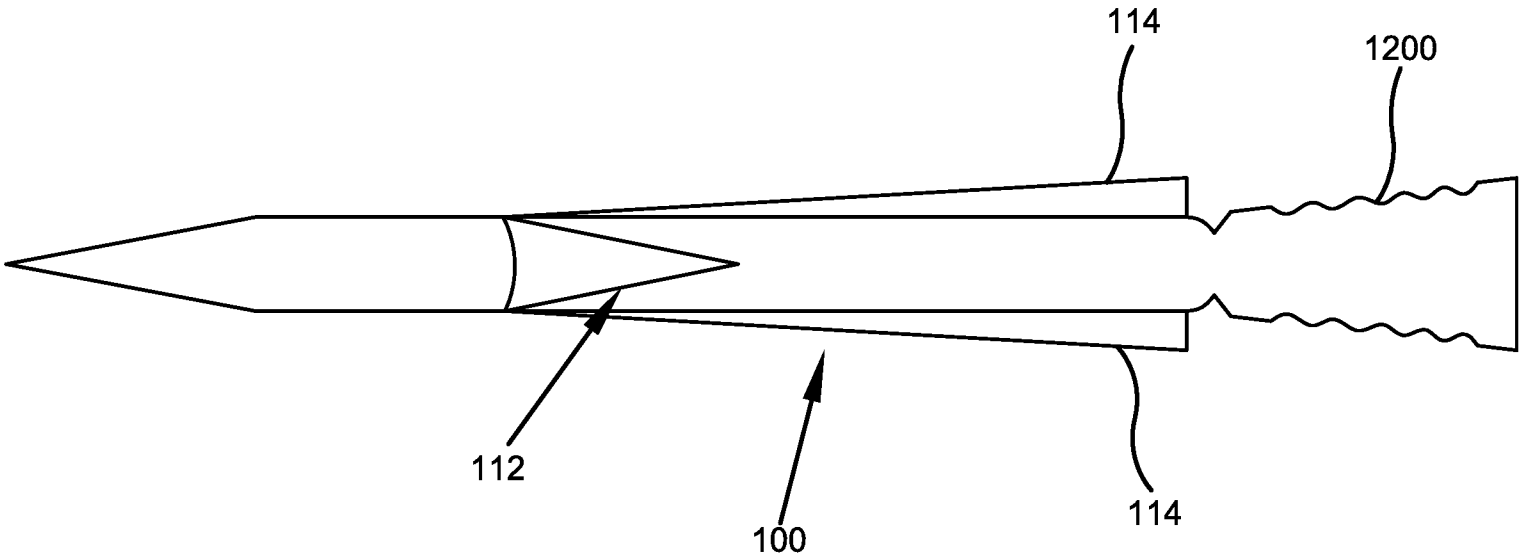
FIG. 3 illustrates a top perspective view of one potential embodiment of an improved projectile device of the present invention in accordance with the disclosed architecture, wherein the projectile has a pair of fins extending outwardly therefrom.

FIG. 3 illustrates a top perspective view of one potential embodiment of an improved projectile device 100 of the present invention in accordance with the disclosed architecture, wherein the projectile 100 has a pair of fins 114 extending outwardly from the body portion 110. More specifically, in this particular embodiment, the body portion 110 has at least two aerodynamic and generally triangular-shaped fins 114, which may be positioned in any orientation or manner around the body portion 110 of the projectile device 100. The configuration of the fins 114 may be that of a straight configuration (i.e., meaning that the fins 114 are substantially in line with the longitudinal axis of the body portion 110), an offset configuration (i.e., meaning that the fins 114 are somewhat rotated about the exterior surface of the body portion 110), or a helical configuration (i.e., meaning that the rotation of the fins 114 about the exterior surface of the body portion 110 is more pronounced).

By way of background, a straight configuration will allow the projectile device 100 to fly through the air at a greater velocity than that of the other configurations due to less air resistance. However, the projectile 100 will rotate less (if at all) and is less accurate at longer distances. By comparison, an offset configuration will allow the projectile device 100 to rotate slightly during its flight path, which produces better accuracy and a more stable flight pattern, but at a slightly reduced speed. Finally, a helical configuration will produce the most rotation of the projectile 100 and the greatest accuracy of the three configurations, but at the lowest flight velocity. In any event, the height of the fins 114 (as measured from the exterior surface of the body portion 110 outwardly) is preferably 0.5 to 2 inches, and the length of the fins 114 (as measured along the longitudinal length of body portion 110) is preferably between 2 and 5 inches.

In differing embodiments of the projectile device 100, the fins 114 may be fixedly or removable attached to the body portion 100, and may be made from a plurality of rigid, semi-rigid, or non-rigid materials such as, but not limited to, stainless steel, aluminum, wood, carbon fiber, plastic, rubber, feathers, artificial feather-like material, etc. As stated above, the presence of the fins 114 may further improve the accuracy, speed, and/or distance of the projectile 100 by producing an increased spin rate (or in differing embodiments of the device 100, a decreased spin rate).

Further, as discussed more fully in relation to FIG. 5 below, the projectile device 100 may be provided as part of a kit that has a plurality of removable fins 114 of differing materials, sizes, lengths, etc. that may be attached to the body portion 110 to produce the desired effect on speed, accuracy, distance, spin-rate, etc. More specifically, the fins 114 may be attached to the body portion 110 in a plurality of means which may include, but is not limited to, a fixed means (e.g. the fins 114 are made of the same singular piece of material as the body portion 110), a grooved/notched channel, a screw fastening system, etc.

FIG. 4 illustrates a perspective view of one potential embodiment of an improved projectile device 100 of the present invention in accordance with the disclosed architecture, and being used with a tensioned device 130 for firing the improved projectile device 100 at an intended target (not shown). More specifically, a tensioned device 130 having a notch engaging member 132 may be used by an individual to propel the projectile 100 toward its intended target. The notch engaging member 132 may be generally u-shaped or v-shaped in differing embodiments, and is preferably made from a durable material, such as a metal, plastic, etc. The member 132 is preferably fixedly attached on each portion of its generally u- or v-shaped body to the elastic band or tension device 130. Further, the tension device 130 may replace the existing propelling means of arrows and the like, such as slingshots, compound bows, recurve bows, spear guns, etc. to provide a means to propel the projectile device 100 with increased speed, spin, accuracy, etc. Further, the notch-engaging member 132 may provide increased durability over the existing means (e.g. bowstring, slingshot band, etc.) that would otherwise cause the propelling means of slingshots/bows to break while attempting to use the projectile device 100.

Notwithstanding, other methods of propelling the projectile device 100 are also contemplated. For example, one such method may include the user simply throwing the projectile device 100 like a spear, dart or other handheld type projectile. However, the projectile device 100 can also be used with existing devices, such as slingshots, compound bows, recurve bows, spear guns, etc. For example, the notch 112 may engage the bowstring of a bow or crossbow, wherein the bowstring (not shown) is secured within the notch 112 between the first and second walls 1120/1122 as the user pulls backwards on the projectile device 100 via the handle 120. In this instance, the backwards pulling of the projectile device 100 would draw the bowstring backwards as it presses against the second wall 1122 of the notch 112 to create tension and the force sufficient to propel the projectile 100 towards its intended target. The projectile device 100 may also be used in a similar fashion with a slingshot, wherein the notch 120 engages the leather pad (not shown) of the slingshot in the same manner as the notch 112 would engage a bowstring, which further allows the user to pull back on the device 100 to create a tension force that propels the projectile device 100 towards its intended target once released.

Additionally, the device may include a target shooting game (not shown) the target shooting game may comprise a plurality of targets or one target surface for practicing accuracy with the device 100. One embodiment of the target may be comprised of a plurality of differing regions worth a differing number of points (e.g. a bullseye) to allow a user to compete against another user by aiming at different regions to score points. In a differing embodiment of the device 100, the target may be comprised of a firm foam material that can be used in conjunction with a blunt-tip attachment of the device 100. This combination allows a user to shoot the projectile 100 at the target without physically penetrating the target surface by using the blunt tip, which ultimately prolongs the life of the target surface.

Figure 5:
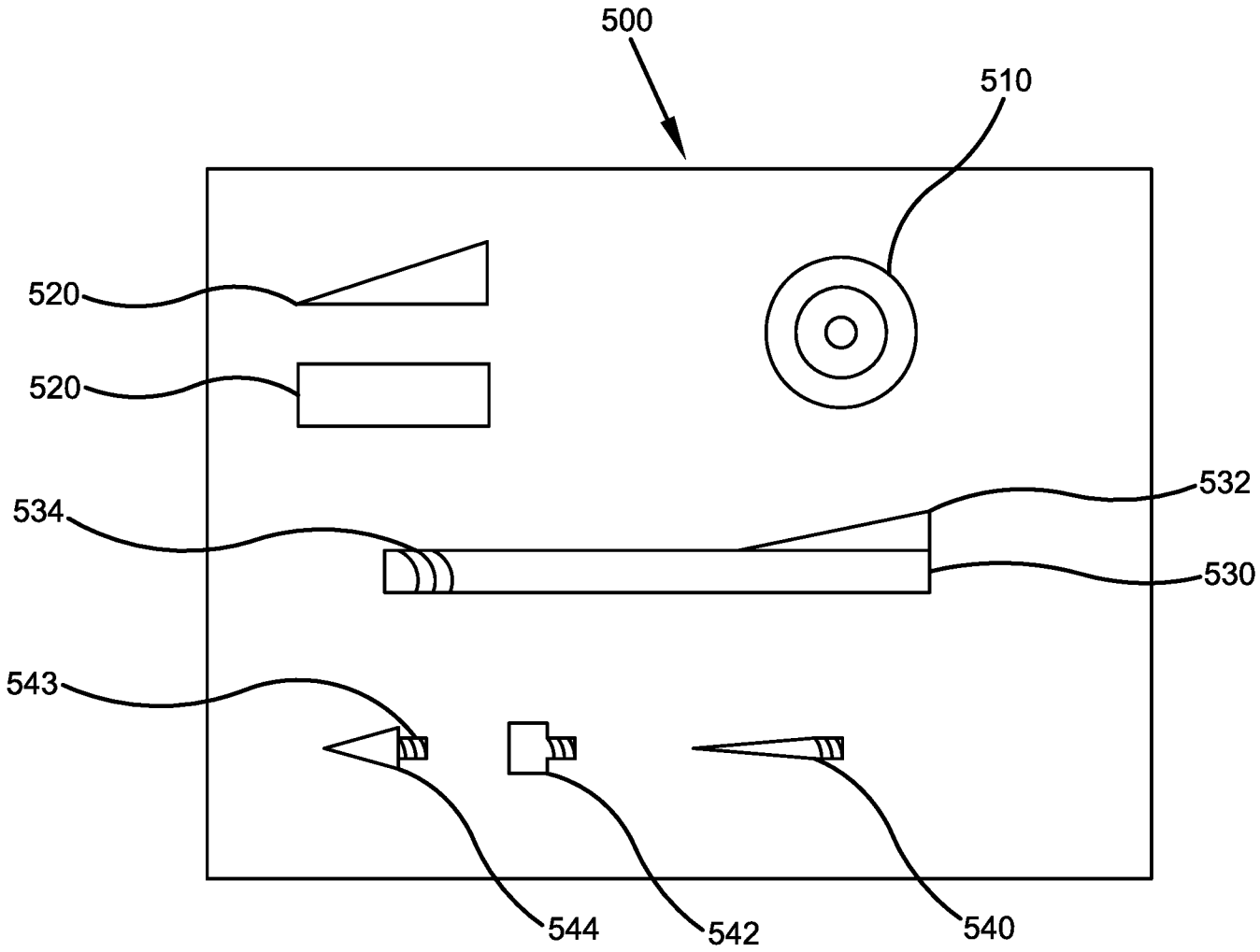
FIG. 5 illustrates a perspective view of one potential embodiment of a kit containing one potential embodiment of an improved projectile device of the present invention in accordance with the disclosed architecture, wherein the kit further comprises a plurality of accessories.

FIG. 5 illustrates a perspective view of one potential embodiment of a kit 500 containing one potential embodiment of an improved projectile device of the present invention in accordance with the disclosed architecture, wherein the kit further comprises a plurality of accessories. More specifically, FIG. 5 illustrates a kit 500, such as a retail package that may be purchased at a retail store or over the internet, that includes a number of different elements which allows a user to customize his or her own projectile. The kit 500 includes a number of different types of targets 510 and various fin configurations 520 to aid in managing the travel of the projectile. The kit 500 includes at least one shaft 530, which has at the front end a treaded receptacle for receiving a removable head 534, and grooves in the base of the shaft to receive different fins 532. While the shaft 530 is shown with a threaded connection it should be understood that the heads may be connected by a snap fit or other quick connect fitting. The kit 500 also includes a number of different head configurations 540, 542 and 544, wherein each of the heads have a threaded end 546.

Certain terms are used throughout the description and claims contained herein to refer to particular features or components of the invention. As one skilled in the art will appreciate, different persons may refer to the same feature or component by different names. This document does not intend to distinguish between components or features that differ in name but not structure or function.

Notwithstanding the forgoing, the improved projectile device 100 and its various components can by any suitable size, shape, and configuration as is known in the art without affecting the overall concept of the invention, provided that it accomplishes the above stated objectives. One of ordinary skill in the art will appreciate that the shape and size of the improved projectile device 100 and its various components, as shown in the FIGS. are for illustrative purposes only, and that many other shapes and sizes of the improved projectile device 100 are well within the scope of the present disclosure. Although dimensions of the improved projectile device 100 and its various components (i.e., length, width, and height) are important design parameters for good performance, the projectile device 100 and its various components may be any shape or size that ensures optimal performance during use and/or that suits user need and/or preference.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A projectile comprising:

a shaft body having a first end and a second end;

a notch in the shaft body that receives a tensioned band, wherein the notch is positioned between the first and second end; and a handle disposed at the second end of the shaft body, wherein the projectile is made from a stainless steel having an alloy and further wherein the alloy is a chromium nickel alloy.

2. The projectile of claim 1, wherein the second end is flared to form the handle.

3. The projectile of claim 1, wherein the notch forms one of an acute angle or a right angle.

4. The projectile of claim 1, wherein the first end is comprised of an interchangeable tip.

5. The projectile of claim 1, wherein the second end comprises a plurality of slits for receiving a corresponding number of fins.

6. The projectile of claim 5, wherein the corresponding number of fins is attached to the plurality of slits, and each of the corresponding number of fins have a straight configuration, an offset configuration, or a helical configuration.

7. The projectile of claim 6, wherein each of the corresponding number of fins have a height ranging from 0.5 to 2 inches.

8. A stainless steel projectile comprising:

a shaft comprised of a chromium nickel alloy, and a notch having an acute angle or a right angle;

an interchangeable tip attached to a first end of the shaft; and at least one fin attached to a second end of the shaft, wherein the at least one fin has a straight configuration, an offset configuration, or a helical configuration.

9. The stainless steel projectile as recited in claim 8, wherein the at least one fin has a height ranging from 0.5 to 2 inches.

* * * * *